United States Patent [19]

Rodway

[11] Patent Number: 4,779,847

[45] Date of Patent: Oct. 25, 1988

[54] METALLURGICAL INJECTION LANCE

[76] Inventor: Jack L. Rodway, 500 Ox Cart Rd., Apt. 425, Ashland, Ky. 41101

[21] Appl. No.: 151,495

[22] Filed: Feb. 2, 1988

[51] Int. Cl.[4] ..... C21C 5/48

[52] U.S. Cl. ..... 266/225; 266/220

[58] Field of Search ..... 266/218, 225, 265, 266, 266/270

[56] References Cited

U.S. PATENT DOCUMENTS

| | | | |
|---|---|---|---|
| 3,495,815 | 2/1970 | Holmes | 266/270 |
| 3,615,085 | 10/1971 | Bernsmann | 266/225 |
| 4,366,952 | 1/1983 | Sorger | 266/225 |

FOREIGN PATENT DOCUMENTS

| | | | |
|---|---|---|---|
| 2834829 | 3/1979 | Fed. Rep. of Germany | 266/225 |
| 2123129 | 1/1984 | United Kingdom | 266/225 |

*Primary Examiner*—L. Dewayne Rutledge
*Assistant Examiner*—Robert L. McDowell
*Attorney, Agent, or Firm*—Griffin, Branigan & Butler

[57] ABSTRACT

A metallurgical lance for injecting a material into molten metal is provided. The lance has a outer conduit with first and second ends, and a material carrier inner conduit for carrying the material to be injected into the molten metal. The inner conduit has a supply end and an injection end and is in part disposed within and throughout the outer conduit. A high temperature heat insulator is disposed around the outer conduit and extends along the outer conduit from at least an intermediate portion thereof to at least the first end thereof whereby all portions of the lance to be disposed in the molten metal are protected by the insulator. A first end closure and a second end closure for the outer conduit have centrally located apertures therein for receiving a portion of the inner conduit. A centering member is disposed in juxtaposition to the first end closure and has an internal configuration in the form of a frustum such that the base of the frustum has dimensions substantially the same as the inside dimensions of the outer conduit and the top of the frustum has dimensions substantially the same as the dimensions of the aperture in the first end closure. Thus, the inner conduit may be disposed within the outer conduit by sliding the inner conduit from the second end of the outer conduit through the outer conduit and to the centering member, where when in contact with the frustum configuration of the centering member, the injection end of the inner conduit is slidable to and centerable with the aperture in the first end closure and thus receivable and passable thereby.

17 Claims, 3 Drawing Sheets

FIG. 4
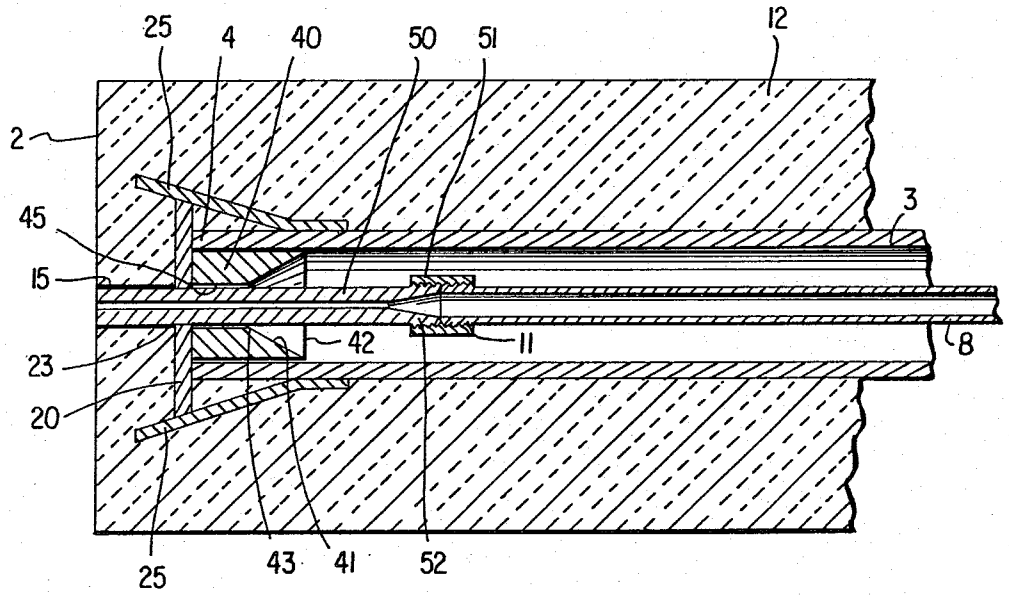
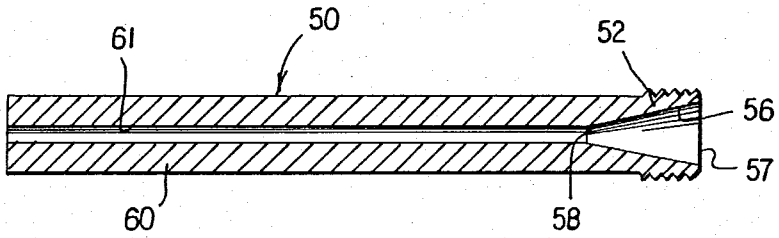
FIG. 5

FIG. 7
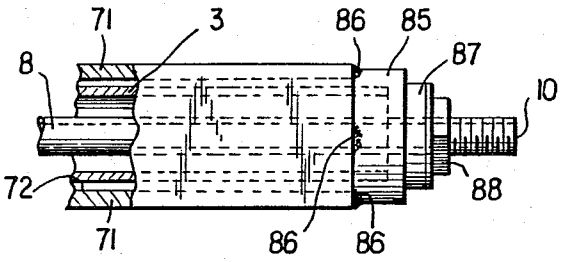
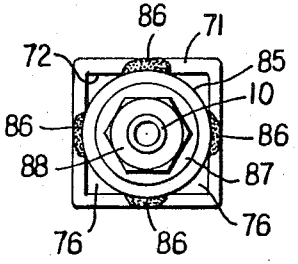
FIG. 8
FIG. 6
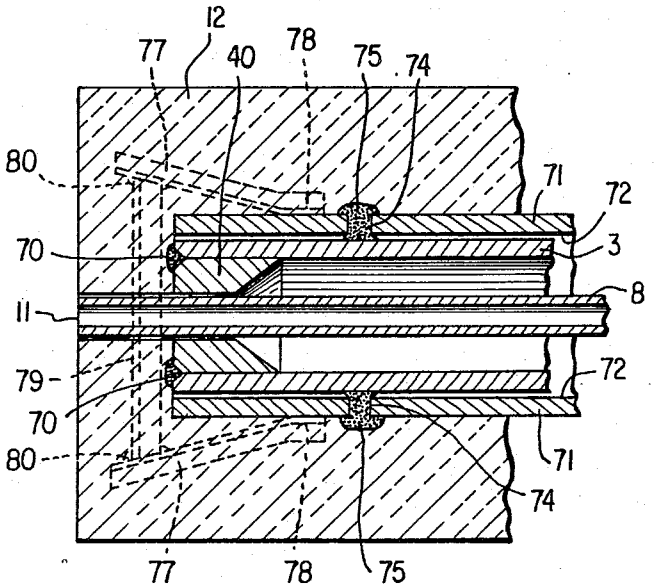

METALLURGICAL INJECTION LANCE

The present invention relates to metallurgical injection lances, and particularly to such lances where the tip and/or the front portion of the lance is subject to deterioration and/or plugging.

BACKGROUND OF THE INVENTION

Metallurgical lances are used for injection of a wide variety of materials into molten metals. Materials which are injected into the molten metal for metallurgical purposes may be both gaseous and particulate solids, as well as non-particulate solids, such as metallurgical wire. The purposes of such injections also vary widely, and these purposes include the injection of refining oxygen, desulfurization compounds and alloying ingredients. The tip and front portion of the lance are disposed beneath the surface of the molten metal during the injection of the materials into the melt, and the high temperatures of the molten metal cause deterioration of that tip and/or front portion. As the tip and/or front portion deteriorates, the lance becomes less effective, and in addition is subject to plugging, such that unpredictable amounts of the material are actually injected into the melt. When this occurs, the lance becomes unservicable, and the lance must be either replaced or repaired.

The more conventional lances are not repairable, and when such deterioration or plugging occur, the unservicable lance must be replaced with a new lance. Lances of the nature are relatively expensive, and the art has sought means of repairing deteriorated or plugged lances. A conventional lance has a support outer conduit, made of, for example, a thick-walled pipe, and a material carrying inner conduit, such as a smaller thick-walled pipe, which is spaced from but within the outer conduit. A high temperature insulator covers the outer conduit, at least along the portions which will be encountered by the molten metal, and more usually the insulator projects from the tip of the lance so as to provide an insulator section beyond the outer conduit. In this latter case, the inner conduit passes through that projection of the insulator and terminates at essentially the end of that projection. Such an arrangement protects the lance, and especially the inner conduit, from the deteriorating and/or plugging environment of the molten metal. It is possible for such lances to be constructed such that when the lance becomes unservicable because of deterioration or plugging of the tip or front portion of the lance, the inner conduit may be moved through the outer conduit and insulator of the lance, with the end of inner conduit passing beyond the projection of the insulator. That deteriorated or plugged portion of the inner conduit is then removed, e.g., sawed away, and the lance then becomes servicable.

However, in such constructions of such lances, there is a relatively small amount of inner conduit which can be moved through the lance and the tip and/or front portion renewed, as explained above, and after that amount of the inner conduit has been so used, the lance is no longer servicable and must be discarded. This is true even though the outer conduit and the insulator may still be quite servicable. Thus, the expensive lance must be discarded, even though most of the portions of the lance are still quite servicable.

It would, of course, be of substantial value to the art to provide a lance where this difficulty can be avoided and where the lance can remain servicable as long as the insulator and outer conduit remain servicable. The present invention provides such an improved lance and with the present improvement, the lance will remain servicable for substantial periods of time.

BRIEF DESCRIPTION OF THE DRAWINGS

FIG. 4 is a cross-sectional view of a wire carrying embodiment of the lance of FIG. 1.

FIG. 5 is an enlarged cross-sectional view of an element of the embodiment of FIG. 4.

FIG. 6 is a partial cross-sectionof the tip end of the lance, showing a preferred embodiment;

FIG. 7 is a partial cross-sectionof the supply end of the lance, showing a preferred embodiment; and FIG. 8 is an end view of FIG. 7.

DETAILED DESCRIPTION OF THE INVENTION

Figure 1:
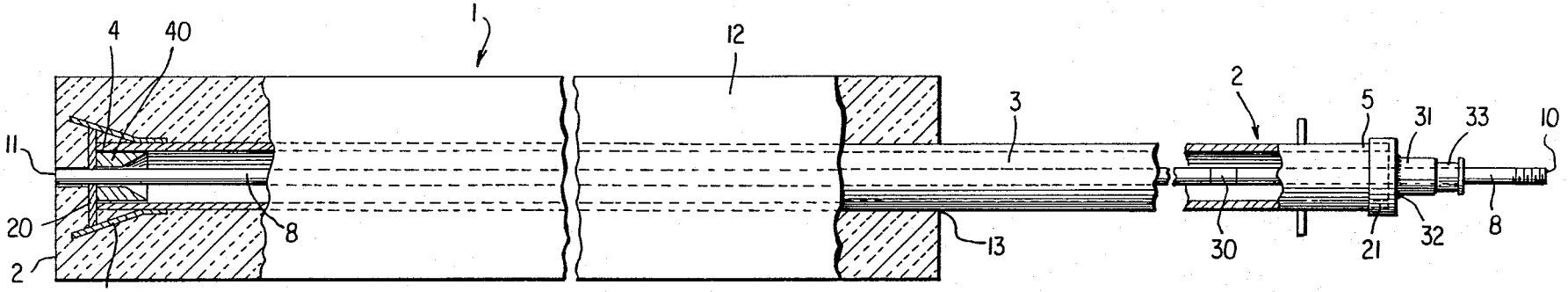
FIG. 1 is a partial cross-sectional view of the lance according to the present invention.

FIG. 1 shows a lance, generally 1, having a tip 2, which is intended to be inserted underneath the surface of molten metal for injection of materials thereinto. The lance has a support outer conduit 3 having a first end 4 and a second end 5. This outer conduit provides general support for the lance and is made of a relatively heavy conduit. Lances of this nature are relatively long and typically can be from 20 to 30 feet in length. Thus, the outer conduit provides substantial support for the lance, especially, since the lances, when in use, are normally supported at a limited number of points, and a substantial cantilevering of the lances may be involved in use. While the outer conduit may be of any shape desired, typically, the outer conduit is a heavy-walled steel pipe. For example a two inches i.d. schedule 80 steel pipe can be used for the outer conduit. The outer conduit will have substantially uniformed inside dimensions (shown by arrow 7 - see FIG. 2), so that predictable inside clearances are provided, for the reasons explained more fully below.

Disposed within outer conduit 3 is a material carrying inner conduit 8. The inner conduit 8 has substantially uniform outside dimensions (see arrows 8 in FIG. 2) which are smaller than the inside dimensions of the outer conduit. This provides a predictable clearance between the outside of the inner conduit 8 and the inside of outer conduit 3 (see FIG. 2). Again, the inner conduit may be of any configuration desired, but typically the inner conduit is also a relatively heavy-gauged steel pipe. For example, when the outer conduit is constructed of $1\frac{1}{2}$ or 2 inches i.d. schedule 80 steel pipe, as described above, the inner conduit may typically be constructed of $\frac{1}{2}$ or $\frac{3}{4}$ inch I.D. schedule 80 steel pipe, which will provide substantial clearance between the inside of the outer conduit 3 and the outside of inner conduit 8. The inner conduit 8 carries therethrough the material to be injected into the molten metal, when the lance is used. The inner conduit has a supply end IO and an injection end 11 and as will-be seen from FIG. 1 the inner conduit is in part disposed within and throughout the outer conduit, with the supply end 10 and the injection end 11 extending beyond the ends of the outer conduit 3.

A high temperature insulator 12 is disposed around outer conduit 3 and extends along the outer conduit from at least an intermediate portion 13 of outer conduit 3 to at least the first end 4 of outer conduit 3. However, in the usual practice, the insulator 12 extends beyond the first end 4 of the outer conduit 3 and provides a passageway 15 (see FIG. 3) through insulator 12 for receiving the injection end 11 of inner conduit 8 whereby the inner conduit is disposed in the passageway 15 such that the injection end 11 is substantially co-terminous with the insulator. By such arrangement, all portions of the apparatus, i.e. the lance, to be disposed in the body of molten metal are protected by the insulator 12, for the reasons explained more fully hereinafter.

Figure 2:
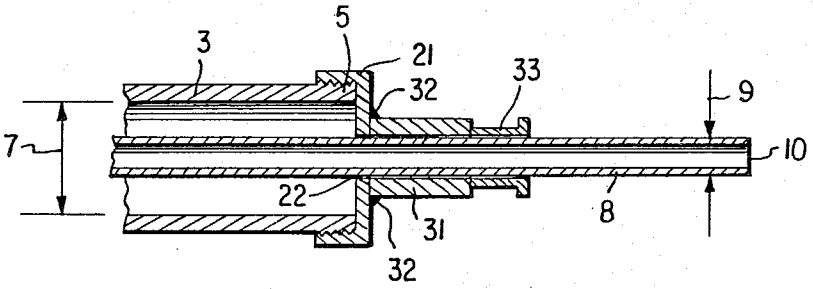
FIG. 2 is an enlarged cross-sectional view of a portion of the lance of FIG. 1.

The outer conduit 3 has a first end closure 20 (see FIGS. 1 and 2) and a second end closure 21 (see FIGS. 1 and 2). Each of the closures 20 and 21 have a centrally located aperture, 22 and 23, for receiving a portion of inner conduit 8. Thus, the portion of the inner conduit disposed within the outer conduit is supported by and spaced from the outer conduit by the two closures 20 and 21.

Typically, the lance will have a "crow foot" 25 at the first end 4 of outer conduit 3. The crow foot is a supporting member for the insulator. Typically, the insulator is made of a refractory material, such as an alumina refractory, and the refractory is hard and heat resistant. Often, for example, when a lance is placed in a ladle of molten metal, the lance is lowered to the bottom of the ladle where the injection tip 11 and the refractory insulator surrounding the same, contacts the bottom of the ladle. This causes some mechanical loading on the refractory, and the crow foot is simply a reinforcing support therefore. The crow foot is typically steel plate or angle iron which has been formed into any desired shape, and protects the first end of the outer conduit 3 and is attached thereto by screws, welding and the like. That reinforcing therefore allows for more sustainable contact by the end of the lance when placing the lance into, for instance, a ladle of molten metal, and in removing the lance therefrom.

The above also generally describes the prior art lances where plugging of the tip or front end portion causes the lance to be unservable and must be discarded. However, as briefly noted above, it is possible to construct the lances so that plugged sections of the inner conduit can be removed and new sections inserted into tip passage 15. Thus, as can be seen from FIG. 1, inner conduit 8, typically made of steel pipe as explained above, is often formed of more than one section of such steel pipe. This is because steel pipe is conventionally made in sections of about 20 feet and two such sections (one of which is appropriately cut to length) must be coupled together to achieve the desired length of the inner conduit of the lance. This coupling may be done with a pipe coupling 30, when the lance is first assembled. In this regard, the lance is assembled by placing inner conduit 8 inside of outer conduit 3. The end closures 20 and 21 are then assembled onto the outer conduit 3 with the inner conduit 8 passing through the apertures 22 and 23 of the end closures 20 and 21. The end closures are then affixed to the outer conduit. Typically, the first end closure 20 is welded to outer conduit 3 and the second end closure 21 is affixed to outer conduit 3 in a removable manner. Thus second end closure 21 can be affixed to outer conduit 3 by bolts, screws, welding and the like, or more simply, it can be threaded onto outer conduit 3 by means of usual pipe threads, as shown in FIG. 2, although this is not the preferred embodiment, as discussed more fully below. Also, preferably, second end closure 21 will have additional support at the supply end 10 of inner conduit 8 and to this end, preferably, a plug 31 will be welded at wells 32 to end closure 21 and a conventional pipe bushing 33 will be screwed thereinto (see FIG. 2). However, it is not necessary to have either plug 31 or bushing 33, but these do provide better closures at the supply end to prevent blowby of gases and the like.

When the tip 2 of the lance is placed beneath the surface of the molten metal, material is passed through inner conduit 8 and out of injection end 11 into the molten metal. Often, such injection sets up a vibration in the lance, and that vibration, along with the heat and the splattering of slag, can cause plugging of injection end 11. When that plugging occurs, the lance must be removed and either the lance is discarded or the plugged injection end 11 of the lance must be unplugged. To this end, the lance is removed from, for example, the ladle, and after cooling, it is possible for inner conduit 8 to be moved through outer conduit 3 such that injection end 11 protrudes from the tip 2 of the lance. This protrusion of inner conduit 8 is sufficient to uncover the deteriorated or plugged portion of injection end 11. That uncovered and deteriorated or plugged portion of injection end 11 is then simply cut off flush with tip 2 and the lance is then returned to service. However, as can be seen from FIG. 1 there is a limited amount of inner conduit 8, and only one or several unpluggings in this manner can be achieved before the excess length of inner conduit 8 is used up. However, when this occurs, closure 21 can be removed when the lance is again plugged, and an additional length of inner conduit 8 can be added to conduit 8 by coupling thereto another length of pipe (not shown) so that further plugged sections of inner conduit 8 may be moved through outer conduit 3 and cut flush with tip 2 of the lance 1.

However, it will be appreciated that when the first pipe coupling 30 traverses the lance, in such unplugging operations, and it abutts the first end closure 20, no more sections of inner conduit 8 can be added to the inner conduit, since coupling 30 is larger than aperture 23 of first end closure 20. Also, it is not possible to totally remove inner conduit 8 and replace it with a new inner conduit. The reason that a new inner conduit 8 cannot be placed in outer conduit 3 is that the length of inner conduit 8 is so long, e.g., usually 20 feet or more, that the inner conduit, from its own weight, will sag while traversing the distance through inner conduit 3 from closure 21 to closure 20. It is therefore essentially impossible to thread a new inner conduit 8 into aperture 23. However, if means were provided to achieve such threading of a new inner conduit 8 in and through aperture 23, then inner conduit 8 could be repeatedly renewed and the lance would remain servicable until the insulator 12 began to breakdown from repeated use and abrasion.

To this end there is provided a means by which a new inner conduit 8 can, indeed, be threaded into the lance. Thus, when the originally manufactured inner conduit 8 has been unplugged by cutting off plugged portions a sufficient number of times that coupling 30 reaches end closure 20, and thus no more inner conduit 8 can be coupled to the existing inner conduit 8, first end closure 21 is simply removed, and the old inner conduit 8 is removed from the lance. A new inner conduit 8 is then passed through outer conduit 3 until it reaches a position near aperture 23. A centering member 40 is disposed in juxtaposition to first end closure 20 and that centering member has an internal configuration in the form of a frustum 41 (see particularly FIG. 3). As can be seen,-the base 42 of the frustum 41 has dimensions that are substantially the same as the inside dimension of the outer conduit and the top 43 of the frustum 41 has dimensions substantially the same as the dimensions of the aperture 23 in end closure 20. Thus, when in contact with the frustum configuration 41 of centering member 40, the injection end 11 of a new inner conduit 8 is slidable to and centerable with the aperture 23 of the first end closure 20 and thus is receivable and passable thereby. After such threading of a new inner conduit 8 is achieved, then second end closure 21 is slipped over the supply end 10 of new inner conduit 8 and affixed to the second end of outer conduit 3, in the manner described above.

When this new inner conduit 8 is used up by virture of a coupling 30 contacting centering member 40, then the lance is again renewed by replacing yet a further new inner conduit into the lance in the manner described above. By this means a number of new inner conduits may be placed in the lance and the lance may continue in service for almost indefinite periods of time, at least so long as the refractory is not substantially worn away by abrasion or other causes.

Figure 3:
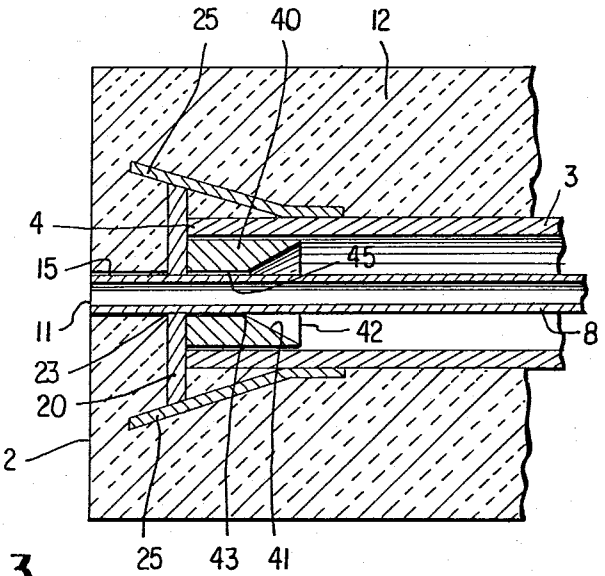
FIG. 3 is an enlarged cross-sectional view of a further portion of the lance of FIG. 1.

Preferably, centering member 40 has an addition to the frustum configuration 41, in the form of a centering member passage 45 which will, of course, have the same internal diameter as the internal diameter of aperture 20 and forms additional support for inner conduit 8. This passage 45 may be of relatively short dimensions, usually no more than 3 or 4 times the center line dimensions of the frustum, and more usually no more than 2 times the center line dimensions of the frustum. As shown in FIG. 3, that passage has a length about equal to the center line length of the frustum. Additionally, centering member 40 and the first end closure 20 can be integral, i.e., made of one piece of material. This simplifies placing the combined centering member 40 and first end closure 20 onto outer conduit 3, but, if desired, those two may be separately manufactured and attached by conventional means such as welding, bolts and the like.

While not shown in the drawing, typically, means are provided for supplying a cooling gas to the lance. Thus, usually, the space between the inner conduit and the outer conduit has means for conducting the cooling fluid therethrough, such as argon, nitrogen or even air and the like, in order to maintain a lower temperature of the lance, during use, than the temperature which would be assumed by the lance by virtue of being placed in the molten metal. In addition, the particulate matter is also most usually introduced into the molten metal in a carrier gas. This carrier gas fluidizes particulate material and flows the particulate material through inner conduit 8 and out of injection end 11. The combination of the cooling fluid in the space between outer conduit 3 and inner conduit 8, the flowing gas through inner conduit 8, and the insulator 12 all function to keep the temperature of the lance, within the molten metal, at a temperature considerably below the temperature of the molten metal.

It is sometimes necessary to inject into the molten metal a metallurgical wire. However, this type of lance, referred to as a two-part lance, requires disassembly of the lance, placing a wire feeder head on the lance, reinsulating the lance, and threading the metallurgical wire through aperture 23, through inner conduit 8 and through aperture 22 in second end closure plate 21. When sufficient metallurgical wire has been threaded, second end closure 21 is reassembled on outer conduit 3 and the lance is then placed into operation. However, if additional wire is required, then that process must be repeated. This results in downtime of the lance and the same concept described above in connection with replacing new sections of inner conduit 8 can be used for threading wire into such a lance. In this regard, inner conduit 8 is provided with a coupling means at the end thereof near tip 2 of the lance. This is shown in FIG. 4, where a wire delivery member 50 is attached to inner conduit 8 by way of a coupling 51. When inner conduit 8 is a pipe, then the coupling is simply a pipe coupling. As seen in FIG. 5, wire delivery member 50 has a wire centering portion 52 adjacent the injection end 11 of inner conduit 8 (see FIG. 4). Wire centering portion 52 has an internal configuration in the form of a frustum 56 such that the base 57 of the frustum has dimensions substantially the same as the inside dimensions of the inner conduit and the top 58 of the frustum has dimensions substantially the same as the outside dimensions of the wire to be delivered therethrough. The wire delivering member 50 has an extension member 60 projecting from the wire centering portion 52 and that projection has a wire receiving aperture 61 extending along the center line of the frustum configuration. The wire delivering member 50 is attached to inner conduit 8 and passed through aperture 23 in the same manner as described above in connection with threading a new inner conduit into aperture 23.

Thus, the wire is disposable within the inner conduit 8 by sliding the wire from the supply end 10 of inner conduit 8 through the inner conduit and to the wire centering portion 52. Accordingly, when in contact the frustum configuration 56 of wire centering portion 52, the end of the wire (not shown) is slidable to and centerable with the wire receiving aperture 61 and thus receivable and passable thereby.

As shown in FIG. 4, preferably, the insulator 12 extends beyond the first end 4 of outer conduit 3, for the reasons explained above. Also, as explained above, a passage 15 is provided through the insulator for receiving extension 60 of wire delivery member 50 and the extension member 60 is disposed in the passage 15 such that the end of the extension member 60 is substantially co-terminous with the insulator. This is important, because while the wire delivery member 50 may be made of any metal, e.g., steel, stainless steel, etc., it is preferably made of a softer material then steel, in order to smoothly center the wire in the wire delivery member. Thus, the wire delivery member is preferably made of a softer material such as copper or brass, and especially brass. Brass, of course, has a much lower melting point than metals normally used in the furnace or ladle into which the lance is placed, and it is important that the insulator provide protection to the brass wire delivery member 50. However, even with such protection, the end portion of the brass extension member 60 will be melted, somewhat, after disposition in the body of the molten metal. When such melting or other deterioration occurs, a further portion of extension 60 may be moved into passage 15 and insulator 12 by moving inner conduit 8 toward tip 2. Eventually, however, the coupling 51 (see FIG. 4) will contact centering member 40 and no further amount of brass extension 60 of wire delivery member 52 may be inserted into passage 15. At this point, inner conduit 8, with wire delivery member 50 is removed from outer conduit 3 in the manner described above in connection with placing a new inner conduit 8 within outer conduit 3. The wire delivery member 50 is then removed from the injection end 11 of inner conduit 8 and a new wire delivery member is attached thereto. That new wire delivery member, attached to inner conduit 8, is then threaded through outer conduit 3, centered by centering member 40, and passed through aperture 23 until the end of the new wire delivery member 52 is substantially co-terminous with tip 2 of the lance. Wire is then threaded through inner conduit 8, centered by the frustum configuration 56, and then passed through aperture 61, in the manner described above.

The taper of the frustum configuration 41 of centering member 40 and the taper of frustum configuration 56 of wire delivery member 50 can range widely. However, the angle between the center line of the frustum and the taper of the frustum is usually no more than 45°, and more preferably no more than 40°. More ideally, that angle will be 30° or less, i.e., between about 15° and 25°. It is obvious, however, that while the frustum configuration has been above described, that other like configurations will serve the same purpose, e.g., elliptical, angular, convex and concave configurations, and the obvious alternative configurations are intended to be embraced by the term fustrum.

The above describes the general mechanical arrangements of lances according to the present invention. However, it has been found that certain specific mechanical arrangements provide better results in terms of rigidity of the lances, convenience of manufacture, and ease of assembly. These arrangements are the preferred embodiment of the invention, and the best mode known in carrying out the invention. These embodiments are shown in FIGS. 6, 7 and 8. In these preferred arrangements, end closure 20 (see FIG. 3) is dispensed with, and instead, centering member 40 (see FIG. 6) is simply welded by welds 70 to outer conduit 3. Alternately, centering member 40 may be brazed thereto or otherwise, essentially, permanently affixed, and such a manner as to form a continuous seal between the periphery of centering member 40 and the inside surface of outer conduit 3. By dispensing with end closure 20, one entire manufacturing step can thereby be eliminated and this not only simplifies the manufacture of the "crow foot" but improve the function thereof, as discussed below.

In addition, as shown in FIGS. 6, 7 and 8, an additional support conduit 71 is provided. This conduit is made of square heavy-walled tubing (see FIG. 8) and has inside dimensions such that inside walls 72 closely approximate the outside diameter of outer conduit 3. Perforations 74 are placed in support conduit 71, at appropriate spaced apart intervals, and support conduit 71 is then spot-welded through those perforations by welds 75 so as to weld the square support conduit 71 to outer conduit 3. The square support conduit 71 provides substantially increased rigidity to the lance such that the lance may be canlevered over substantial lengths without significant bending of the lance due to the weight thereof. In addition, as shown in FIG. 8, the square configuration of support conduit 71, in combination with a round configuration of outer conduit 3 provides vents 76 along the entire length of the lance. This provides additional insulation and cooling to the lance so that the temperature of the lance, while being in molten metal, is even further decreased. If desired, air or other gas, such as argon or oxygen, can be forced through these vents, although natural convection of ambient air through those vents is usually sufficient to provide the additional cooling desired.

With the use of the square outer conduit 71, the design of the crow feet can be simplified for manufacturing purposes, and in addition, the crow feet provide substantially better support for the insulation. As can be seen in FIG. 6, the crow feet can therefore simply be, for example, angle iron 77 which is welded to support conduit 71 at wells 78. That angle iron can then be appropriate braced by additional pieces of angle iron 79 welded to angle iron 77 at wells 80. This provides a crow foot of a cage-like configuration and provides substantially increased support to the insulation 12 such that the insulation is able to withstand greater impacts and prolong the life of the lance.

Also, by use of the square outer conduit 71, the end closure 21 (see FIGS. 1 and 2) can be simplified in manufacture and improve the ease of assembly. As shown in FIGS. 7 and 8, the end closure may thus simply be a conventional pipe coupling 85 welded at wells 86 to square conduit 71. The outer conduit 3 is simply screwed into that pipe coupling. A conventional pipe bushing 87 can therefore be simply screwed into the other end of coupling 85 and that bushing 87 is chosen such that it has the correct bushing size for passing inner conduit 8 therethrough so that the supply end 10 projects therefrom. Bushing 87, therefore, functions as the end closure and can be easily removed from the lance simply by unscrewing with a wrench around nut portion 88 of the bushing. This makes manufacture, assembly and disassembly of the lance for renewing inner conduit 8 much simplier and in addition provides very good support for inner conduit 8.

Otherwise, in these preferred embodiments, the lance is constructed in the manner described above in regard to the general description of lances suitable for the present invention. Thus, the insulation is the same as described above, and the means of unplugging the lance and renewing inner conduit 8, as well as the use of the wire centering member, are all as described above.

As can thus be appreciated from the above, the present invention provides a very substantial improvement in the art in that the inner conduit of a lance can be continually renewed, as needed, and the lance can continue in service for the entire life of the insulator or the other mechanical arrangements of the lance and the lance does not become unservicable simply by being plugged or by using up the length of inner conduit originally assembled into the lance. This very substantially improves the overall life of the lance, and with the present improvements, lances can be fully servicable for 5 to 20 times the servicable life of a lance without the present improvements. In addition, with the present arrangement, wire may be conveniently threaded through the lance for injection into molten metal. As additional wire is required, additional lengths of wire may be similarly threaded without disassembly of the lance, as was required by prior art two-part lances. In addition, as a delivery member is melted or deteriorated with use, a new delivery member may be easily placed in the lance and wire rethreaded therethrough. In view of the foregoing, the present invention provides a very substantial improvements in the art.

What is claimed is:

1. An apparatus for injecting a material into a body of molten metal wherein a portion of the apparatus is disposed in the body of molten metal, comprising:

(1) a support outer conduit having substantially uniform inside dimensions and first and second ends;

(2) a material carrier inner conduit having substantially uniform outside dimensions which are smaller than the inside dimensions of the outer conduit for carrying the material to be injected into the molten metal, said inner conduit having a supply end and an injection end and being in part disposed within and throughout the said outer conduit;

(3) a high temperature heat insulator disposed around the said outer conduit and extending along the outer conduit from at least an intermediate portion thereof to at least the first end thereof whereby all portions of the apparatus to be disposed in the body of molten metal are protected by said insulator;

(4) a first end closure and a second end closure for the outer conduit, each closure having a centrally located aperture therein for receiving a portion of the inner conduit, whereby the portion of the inner conduit disposed within the outer conduit is supported by and spaced from the outer conduit by the said closurers;

(5) a centering member disposed in juxtaposition to said first end closure and having an internal configuration in the form of a frustum such that the base of the frustum has dimensions substantially the same as the said inside dimensions of said outer conduit and the top of the frustum has dimensions substantially the same as the dimensions of the aperture in the said first end closure;

whereby the inner conduit may be disposed within the outer conduit by sliding the inner conduit from the second end of the outer conduit through the outer conduit and to the centering member, wherein when in contact with the frustum configuration of the centering member, the injection end of the inner conduit is slidable to and centerable with the aperture in the first end closure and thus receivable and passable thereby.

2. The apparatus of claim 1, wherein the molten metal is contained in a ladle furnace and the length of the said insulator is sufficient such that at least the said first end of the outer conduit and the injection end of the inner conduit are disposable beneath the surface of the molten metal and material injected into the molten metal through the inner conduit enters the molten metal beneath the surface thereof.

3. The apparatus of claim 1, wherein the outer conduit and the inner conduit are made of steel pipes.

4. The apparatus of claim 2, wherein the said insulator extends beyond the said first end of the outer conduit, and a passageway is provided through the insulator for receiving the inner conduit and the inner conduit is disposed in said passageway such that the injection end is substantially co-terminous with the insulator.

5. The apparatus of claim 1, wherein the insulator is a refractory.

6. The apparatus of claim 1, wherein the first end closure and the centering member are integral.

7. The apparatus of claim 1, wherein the second end closure is removable for facilitating the placement of the inner conduit within the outer conduit.

8. The apparatus of claim 1, wherein the space between the inner conduit and the outer conduit has means for conducting a fluid therethrough.

9. The apparatus of claim 1, wherein the injection end of the inner conduit has a wire delivery member attached thereto, said wire delivery member having a wire centering portion adjacent the injection end of the inner conduit and the wire centering portion has an internal configuration in the form of a frustum such that the base of the frustum has dimensions substantially the same as the inside dimensions of the said inner conduit and the top of the frustum has dimensions substantially the same as the outside dimensions of the wire to be delivered therethrough, and said wire delivery member has an extension member projecting from the wire centering portion and having a wire receiving aperture extending along the centerline of the frustum configuration,;

whereby wire is disposable within the inner conduit by sliding the wire from the supply end of the inner conduit, through the inner conduit and to the wire centering portion, wherein when in contact with the frustum configuration of the wire centering portion, the end of the wire is slidable to and centerable with the wire receiving aperture and thus receivable and passable thereby.

10. The apparatus of clai 9, wherein the said insulator extends beyond the said first end of the outer conduit, a passage is provided through the insulator for receiving the extension member and the extension member is disposed in the passage such that the end of the extension member is substantially co-terminous with the insulator.

11. The apparatus of claim 10, wherein at least the extension member is made of brass.

12. The apparatus of claim 1, wherein the end portion of the brass extension member, at least in part, is deteriorated or melted after continued disposition in the said body of molten metal, the extension member is movable by the inner conduit further into the said passageway such that the end of the extension member is again co-terminous with the said insulator.

13. The apparatus of claim 1, wherein the outer conduit and the inner conduit are pipes and a square crosssectional support conduit extends along substantially the length of the outer conduit, with outside walls of the outer conduit being in close proximity to the inside walls of the support conduit, and said support conduit being affixed to said outer conduit by attachments passing through performations in walls of the support conduit.

14. The apparatus of claim 13, wherein the attachments are welds.

15. The apparatus of claim 13, wherein vent portions are provided between outside walls of the outer conduit and inside walls of the support conduit.

16. The apparatus of claim 13, wherein the said end closure near its said supply end of the inner conduit is a pipe coupling welded to said square support conduit at the end thereof and being fitted with a bushing for passing the inner conduit therethrough.

17. The apparatus of claim 13, wherein a crow foot support for the insulator is made of angle iron welded to outside walls of the square support conduit.

* * * * *